US006355007B1

(12) United States Patent
Zuckerbrod

(10) Patent No.: US 6,355,007 B1
(45) Date of Patent: Mar. 12, 2002

(54) HAND HELD MASSAGE DEVICE

(76) Inventor: Pamelia Zuckerbrod, 5961 NW. 99th Ave., Parkland, FL (US) 33067

( * ) Notice: Subject to any disclaimer, the term of this patent is extended or adjusted under 35 U.S.C. 154(b) by 0 days.

(21) Appl. No.: 09/303,761

(22) Filed: May 3, 1999

Related U.S. Application Data

(63) Continuation-in-part of application No. 08/991,039, filed on Dec. 16, 1997, now abandoned.

(51) Int. Cl.[7] ..... A61H 15/00; A45D 29/05; A45D 29/14

(52) U.S. Cl. ..... 601/72; 601/80; 601/101; 132/73.6; 132/75.8; 132/76.5

(58) Field of Search ..... 601/46, 67, 69, 601/70, 72–74, 78, 80, 81, 84, 97, 101–3, 107–111, 112–4, 133–140; 132/73.5, 73.6, 75.3–75.6, 75.8, 76.4, 76.9, 314, 315

(56) References Cited

U.S. PATENT DOCUMENTS 1,881,737 A * 10/1932 Lidseen
2,644,446 A 7/1953 Viniegra
3,654,917 A 4/1972 Dienner
3,672,355 A * 6/1972 Ogawa et al.
3,830,232 A * 8/1974 McNair
3,933,151 A 1/1976 Huie
4,059,100 A * 11/1977 Glage
4,187,837 A 2/1980 Braun
4,930,529 A * 6/1990 Whitney ..... 13/73

* cited by examiner

*Primary Examiner*—Danton D. DeMille
(74) *Attorney, Agent, or Firm*—Oltman, Flynn & Kubler

(57) ABSTRACT

A hand held massage device comprising a main body having a top housing and a bottom housing, a vibration source and a vibration surface. The vibration source comprises a bracket having a channel extending longitudinally therethrough, an arm extending axially out from the channel and a motor seated within the channel. The bracket, arm and motor are structured to be retained within an interior chamber formed by the top and bottom housings. The vibration surface comprises a vibration application tool having a first end structured to be removably inserted in a coupling channel on the arm and an opposite second end structured to receive at least one finger thereon and to transmit vibrations to such fingers.

7 Claims, 22 Drawing Sheets

HAND HELD MASSAGE DEVICE

This application is a CIP of Ser. No. 08/991,039, filed Dec. 16, 1997, now abandoned.

BACKGROUND OF THE INVENTION

1. Field of the Invention

The present invention relates to a device for manicuring fingernails and massaging fingers. In particular, the invention relates to a hand-held device for manicuring fingernails and massaging fingers with vibration.

2. Description of the Related Art

Various vibrating finger massagers are known. In general, these types of finger massagers apply a vibrating pressure to finger nails themselves, in an attempt to promote circulation under the nail and to promote nail growth. It also provides a relaxing feeling for the user.

One such device is shown in U.S. Pat. No. 4,187,837 to Braun. This device has a plurality of vibrating bars that contact the fingernails and thumbnail when the device is held in a hand. Another such device is shown in U.S. Pat. No. 2,644,446 to Viniegra, which shows a fingertip massager that applies a vibratory massage to the fingernails. The device has a motor and a plurality of massaging points that contact the tips of the fingernails. Other massaging devices are shown in U.S. Pat. No. 3,933,151 to Huie.

A manually-operated finger massager is shown in U.S. Pat. No. 3,654,917 to Dienner. This device is intended to massage the finger joints and to relieve arthritis.

While all of the devices work well for their intended purpose, none of the above-described devices provide a motorized massaging device that is capable of massaging the portion of the finger between the first and second finger joints. Massaging this area improves the flow of blood around the finger and helps to promote growth of the nails and wellness of the fingers and hands. Moreover, none of the above-described devices adequately direct the vibrational energy predominantly towards the massaging points so that vibrations applied to the main housing and, consequently, the user's hand, are minimized.

SUMMARY OF THE INVENTION

The present invention is directed towards a new and improved hand held massage device comprising a main body having a top housing and a bottom housing, a vibration source and a vibration surface. The vibration source comprises a bracket having a channel extending longitudinally therethrough, an arm extending axially out from the channel and a motor seated within the channel. The bracket, arm and motor are structured to be retained within an interior chamber formed by the top and bottom housings. The vibration surface comprises a vibration application tool having a first end structured to be removably inserted in a coupling channel on the arm and an opposite second end structured to receive at least one finger thereon and to transmit vibrations to such fingers. Alternatively, the top and bottom housings may be spaced apart from one another and include opposing vibration pads, operatively connected to the vibration source, structured for receipt of a finger therebetween.

It is an object of the present invention to provide a new and improved massage device which has all the advantages of the prior art devices and none of the disadvantages.

It is a further object of the present invention to provide a novel hand held apparatus for massaging the area of the finger between the first and second finger joints.

It is another object of the invention to provide an apparatus for massaging fingers that is lightweight and easily transportable.

It is yet another object of the invention to provide an apparatus for massaging fingers that can be opened up and converted to massage other parts of the body.

It is yet a further object of the present invention to provide an apparatus for massaging fingers that is compact and unobtrusive.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENTS

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1A:
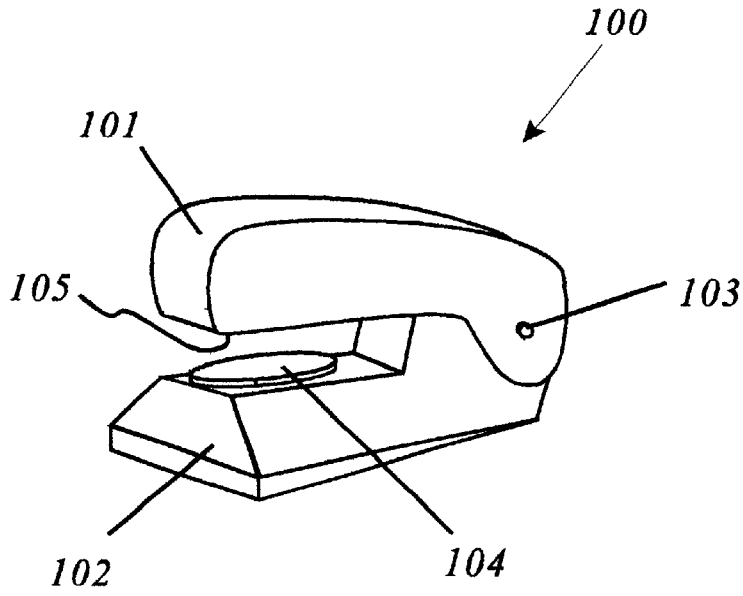
FIG. 1A is a perspective view of one embodiment of the device according to the invention.
Figure 1B:
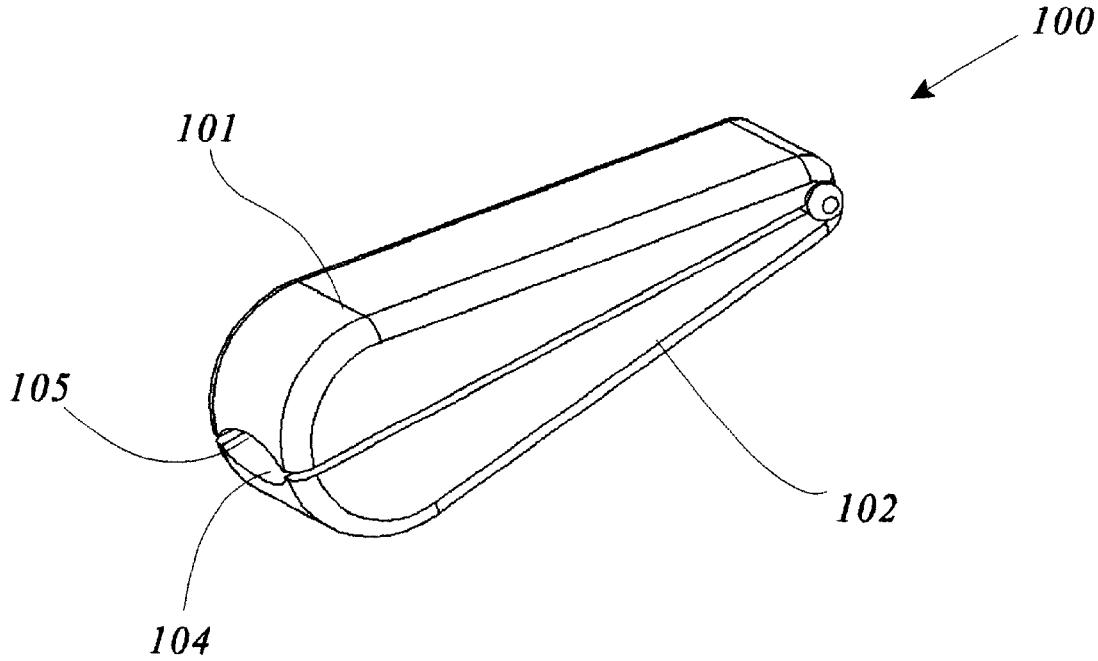
FIG. 1B is a perspective view of an alternative embodiment of the device according to the invention.
Figure 1C:
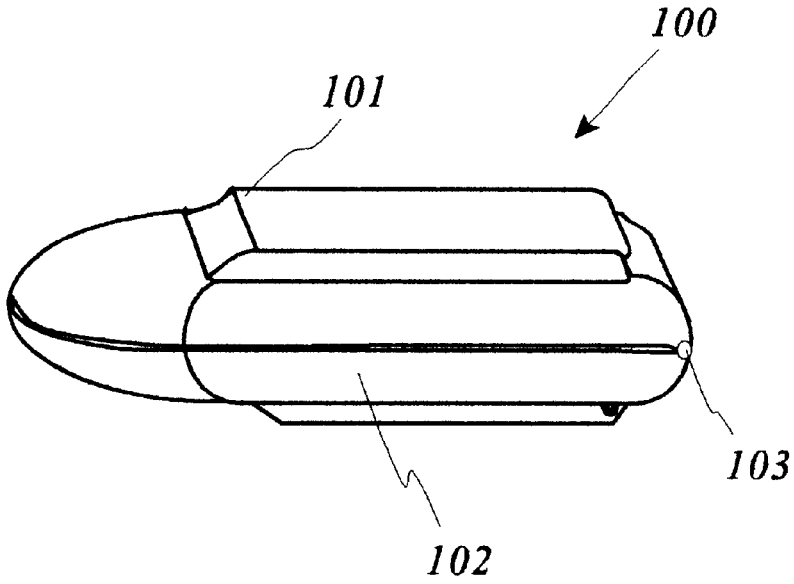
FIG. 1C is a perspective view of another alternative embodiment of the device according to the invention.
Figure 1D:
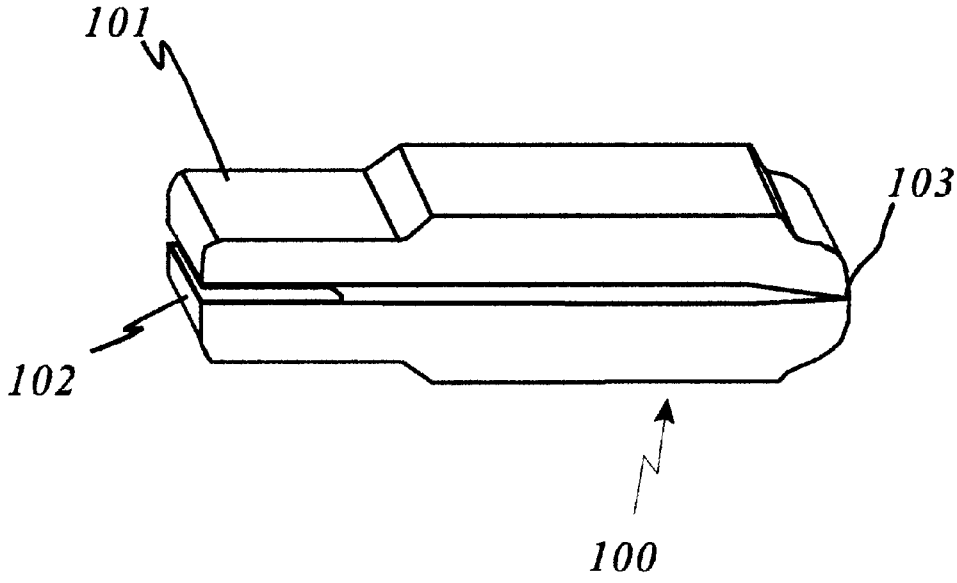
FIG. 1D is a perspective view of yet another alternative embodiment of the device according to the invention.
Figure 2:
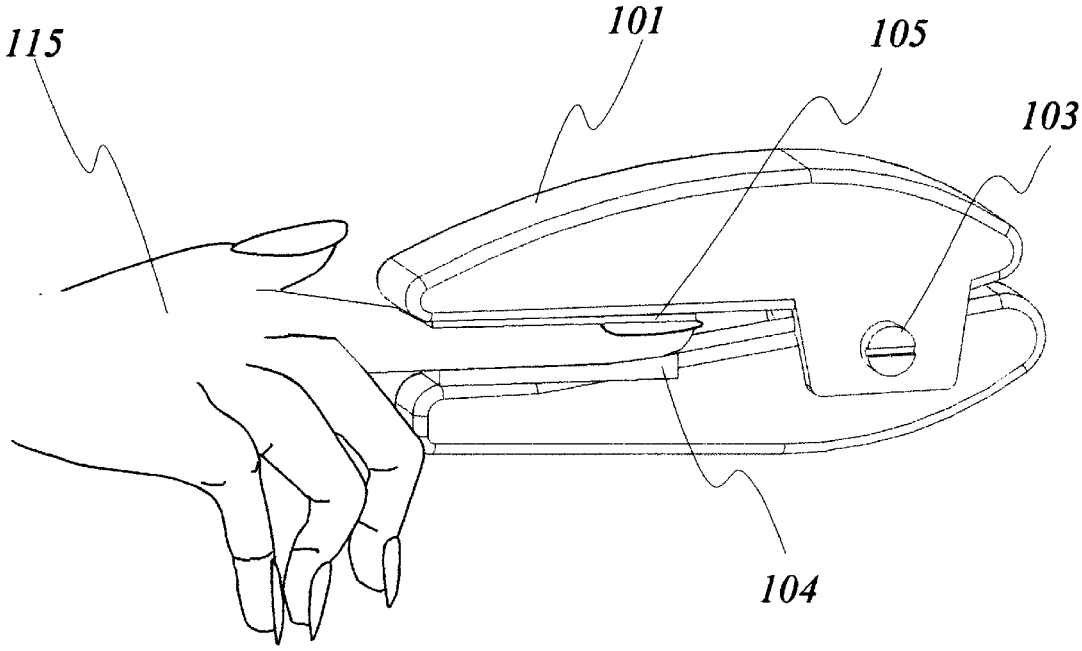
FIG. 2 is a perspective view of the device according to the invention in use.

Turning now in detail to the drawings, and in particular, FIGS. 1A–1D, there is shown perspective views of several different designs of the device according to the invention. Device 100 comprises a top housing 101, a bottom housing 102, and vibration pads 104 and 105. Top housing 101 is connected to bottom housing 102 by a hinge 103, so that device 100 can be opened to allow for positioning of a finger between vibration pads 104 and 105, as shown in FIG. 2.

To use device 100, a finger is placed between pads 104 and 105 so that the area between the first and second joints contacts pads 104 and 105. Housings 101 and 102 are then pressed together to gently clamp the finger in between housing 101 and 102 and to apply a gentle pressure to the finger. Pads 104 and 105 are preferably constructed of a soft plastic material such as silicone rubber or high density polyethylene. The material durometer is selected to match the vibration transmission rates and energy dissipation qualities desired.

Figure 3:
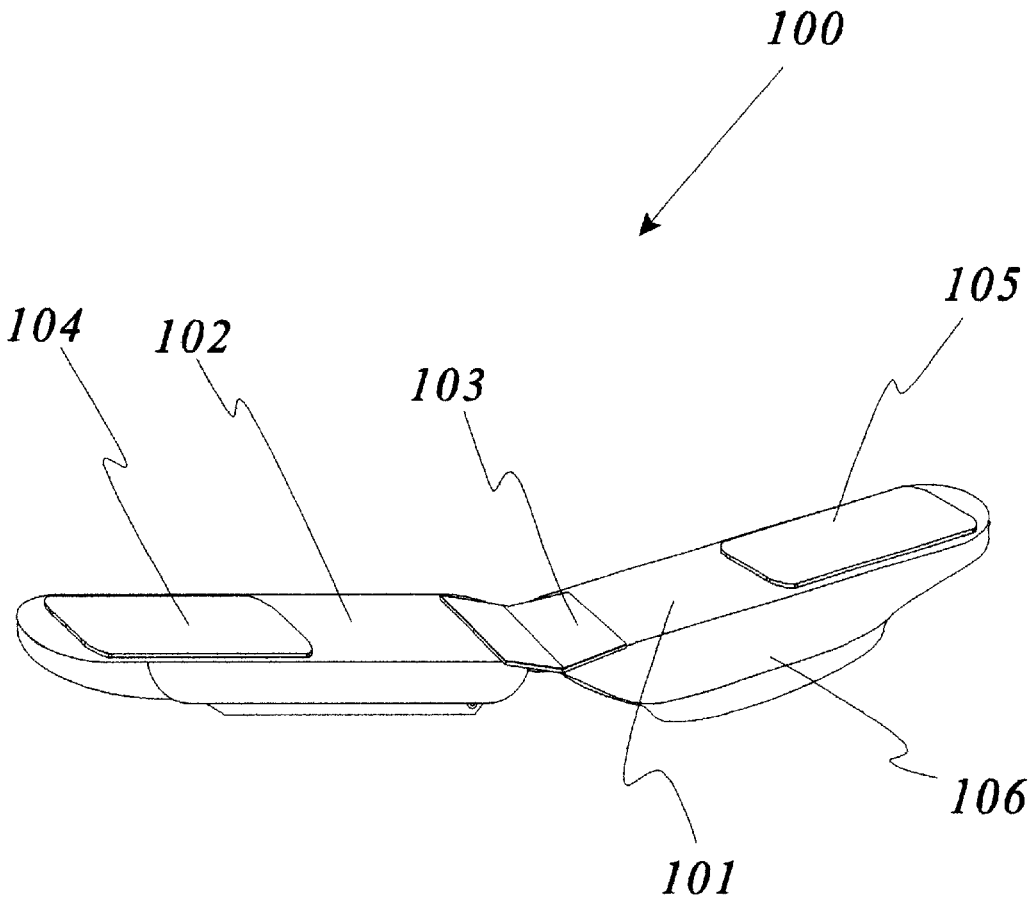
FIG. 3 is a perspective view of the device according to the invention in the open position.

FIG. 3 shows the device according to the invention in an open state so that it can be used as a general massager on any part of the body. The apparatus could then be conveniently held in one hand and used on any part of the human body that needs to be massaged. Housings 101 and 102 together with hinge 103 are preferably constructed from a single injection mold, so as to minimize the manufacturing and assembly costs of the apparatus.

Figure 4:
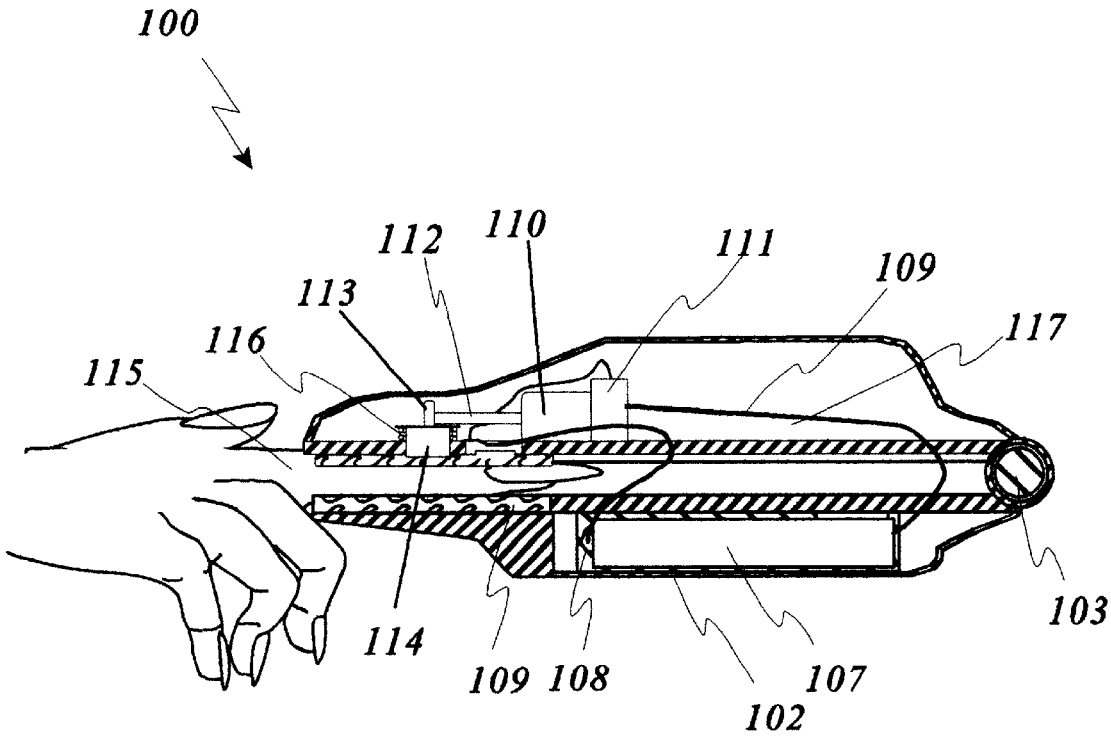
FIG. 4 is a cross-sectional view of the device according to the invention in use.

FIG. 4 shows a cross sectional view of device 100 in use with finger 115 inserted and clamped between pads 104 and 105. A spring 116 can be used to provide the required pressure during massaging. However, it is preferable that the operator of the device apply the required pressure, by squeezing top housing 101 and bottom housing 102 together against finger 115. Finger 115 can be rotated relative to the surface of vibration pads 104 and 105 so that the massage can be applied to all areas of the finger.

The massage is created with a motor 110, which applies a vibrating motion to pad 105. Vibration pad 105 is connected to a cam member 113, which is attached to motor 110 by a shaft 112. A pressure sensitive switch is provided which serves to close a circuit and power motor 110 when pressure is applied to pads 104 and 105. A chamber 117 is molded into housing 101 and serves as a sound muffler for the device during use. Chamber 117 has a motor bracket 111 molded integrally therewith for holding motor 110 firmly in place during operation.

Motor 110 is powered by battery 107, which is mounted in a terminal holder 108. Power from battery 107 travels through wire 109 to motor 110. Battery terminal holder 108 is firmly mounted in bottom housing 102, so that the entire battery assembly and wires can be easily attached to the device.

Figure 5:
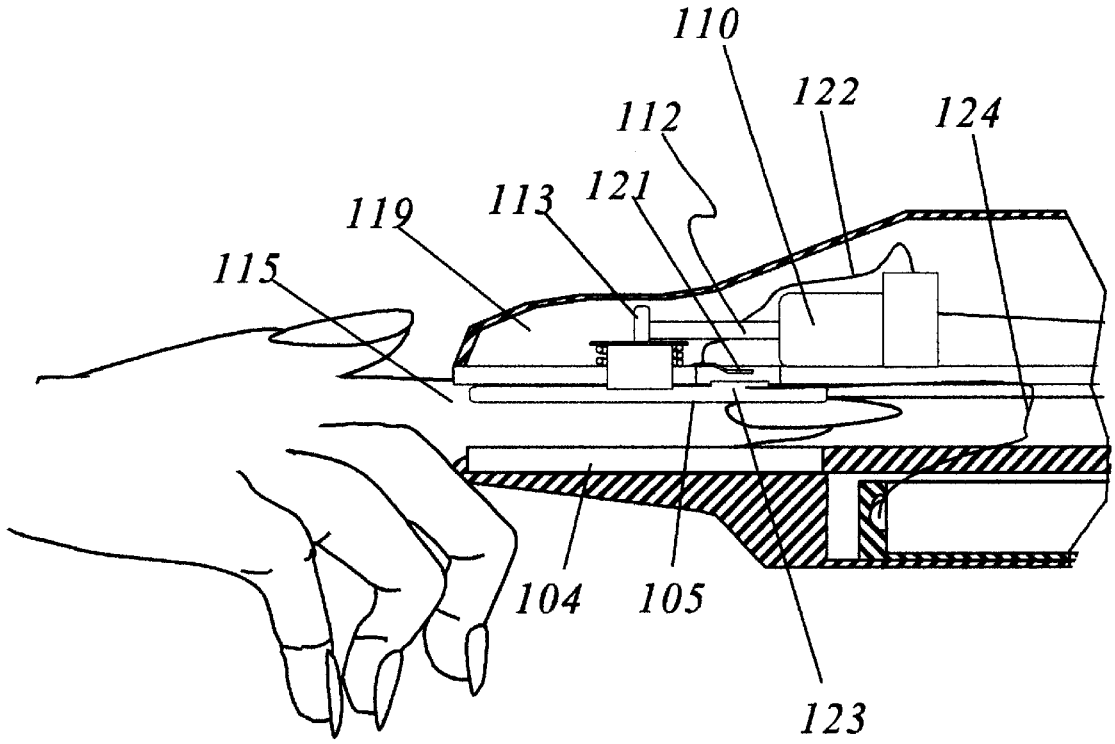
FIG. 5 is an enlarged view of the device shown in FIG. 5.

FIG. 5 shows an enlarged view of the device with finger 115 inserted therein. Cable 124 connects one lead of battery terminal 108 to switch terminal member 123, which connects to vibration pad 105. Terminal 123 is attached directly to vibration pad 105 so that any pressure applied to pad 105 will cause terminal 123 to contact spring-loaded terminal 121, and close the circuit. Wire 122 then transmits current from battery 108 to motor 110 once the circuit is closed. Motor 110 then rotates at speeds of up to 12,000 revs per minute.

The rotation of motor 110 is transmitted to an eccentrically mounted cam 120, which is preferably a disc mounted off-center on a shaft 112 connected to motor 110. The centrifugal force generated by the off-center rotation of cam 113 creates a vibration energy that is transmitted to vibration pad 105 by the spring loading force acting on pad 105. The vibration from cam 113 is thus transmitted to a finger or other body part that is in contact with pad 105.

Figure 6:
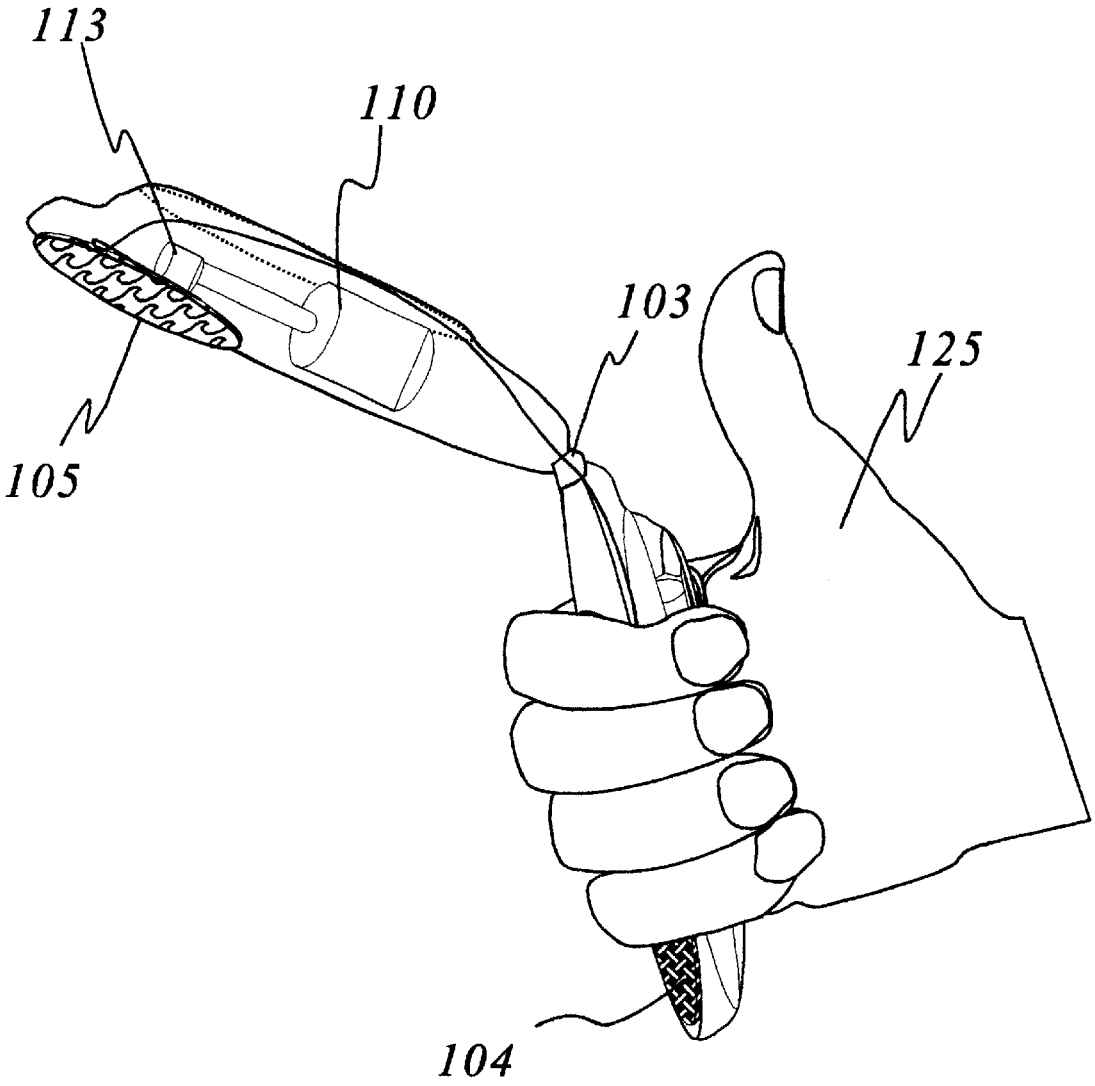
FIG. 6 is a partial sectional view of the device shown in FIG. 3.

FIG. 6 shows device 100 in the open position, where it can be used to massage other parts of the body. In this mode of operation, bottom housing 102 is held in one hand exposing pad 105 on housing 101. Housing 101 is then pressed against the regions of the body to be massaged. The dimensions of device 100 are designed to fit snugly in the palm of the hand so that the apparatus could be easily manipulated by the user. Device 100 is preferably designed small enough so that it could fit in a purse when not in use.

Figure 7A:
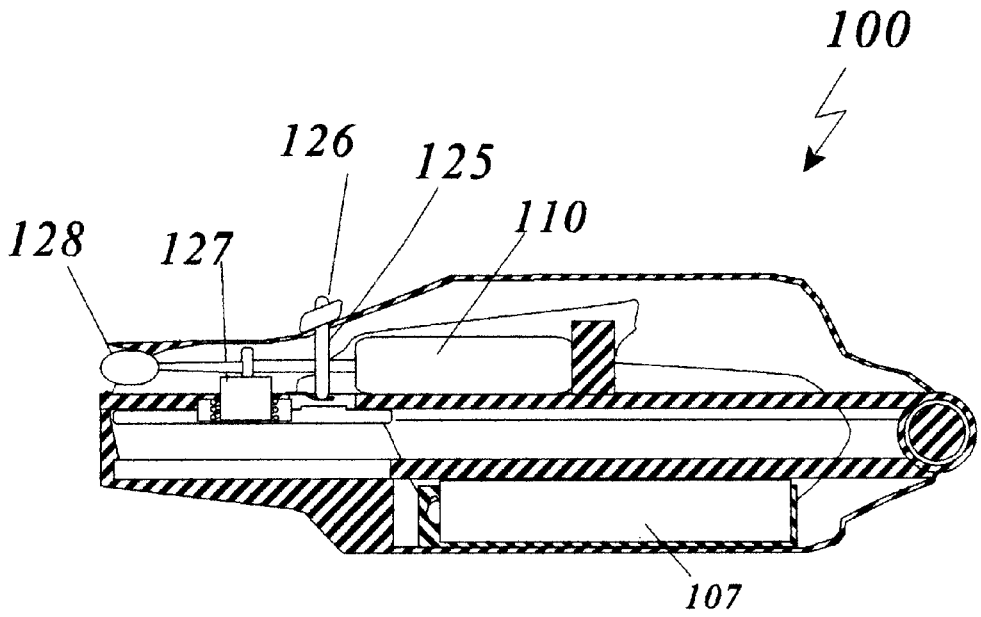
FIG. 7A is a cross-sectional view of an alternative embodiment of the device according to the invention having a buffer wheel.
Figure 7B:
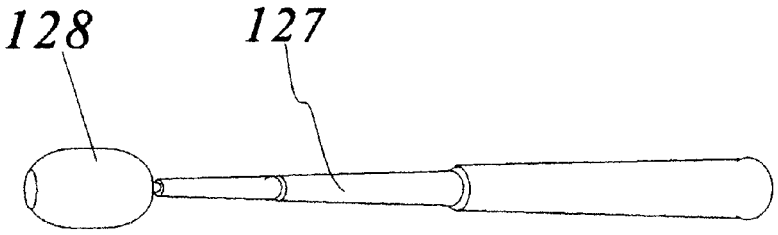
FIG. 7B is a perspective view of the buffer wheel shown in FIG. 7A.

FIG. 7A shows an alternative embodiment of the device according to the invention. In this embodiment, device 100 includes a buffing wheel 128 attached to telescoping shaft 127, shown in FIG. 7B. Shaft 127 is connected to motor 110, so that shaft 127 and thus wheel 128 rotates when motor 110 is activated. Buffing wheel 128 serves to buff and polish finger nails during manicuring. Telescoping shaft 127 is extended when buffing wheel 128 is in use, and can then be retracted for convenient storage.

An extra, manually-operable switch 126 is connected to pressure sensitive terminals 121 and 123, so that motor 110 can be turned on without applying pressure to pad 105. This embodiment is also capable of opening such as shown in FIG. 6.

Figure 8:
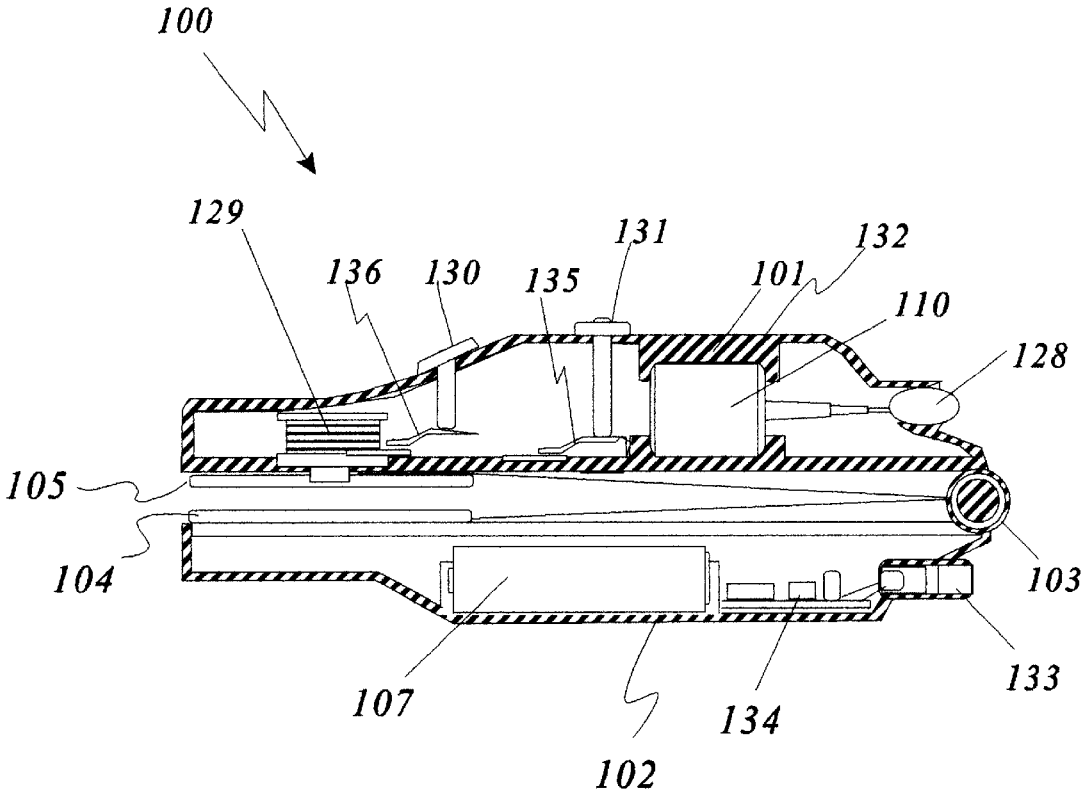
FIG. 8 is a cross-sectional view of an alternative embodiment of the device according to the invention.

FIG. 8 shows another alternative embodiment of the invention, which employs an electromagnetic coil 129 to provide dedicated power to vibration pad 105. Electromagnetic coil 129 can vibrate at rates of about 3600 beats per minute. In this embodiment, pad 105 is directly connected to electromagnetic coil 129 and is powered by depressing switch 130. This causes terminal 136 to close the circuit and provide power to coil 129. A separate motor 110 is provided to power buffing wheel 128. Switch 131 serves to power motor 110 by causing terminal 135 to close the connection to battery 107. Motor 110 is mounted inside motor bracket 132 which is integrally molded with top housing 101.

Also shown in FIG. 8 is an external power connection 133, which allows for direct connection of device 100 into a wall socket. A circuit 134 is also provided to regulate and control the functioning of the apparatus so that electrical overloads could be prevented.

Figure 9:
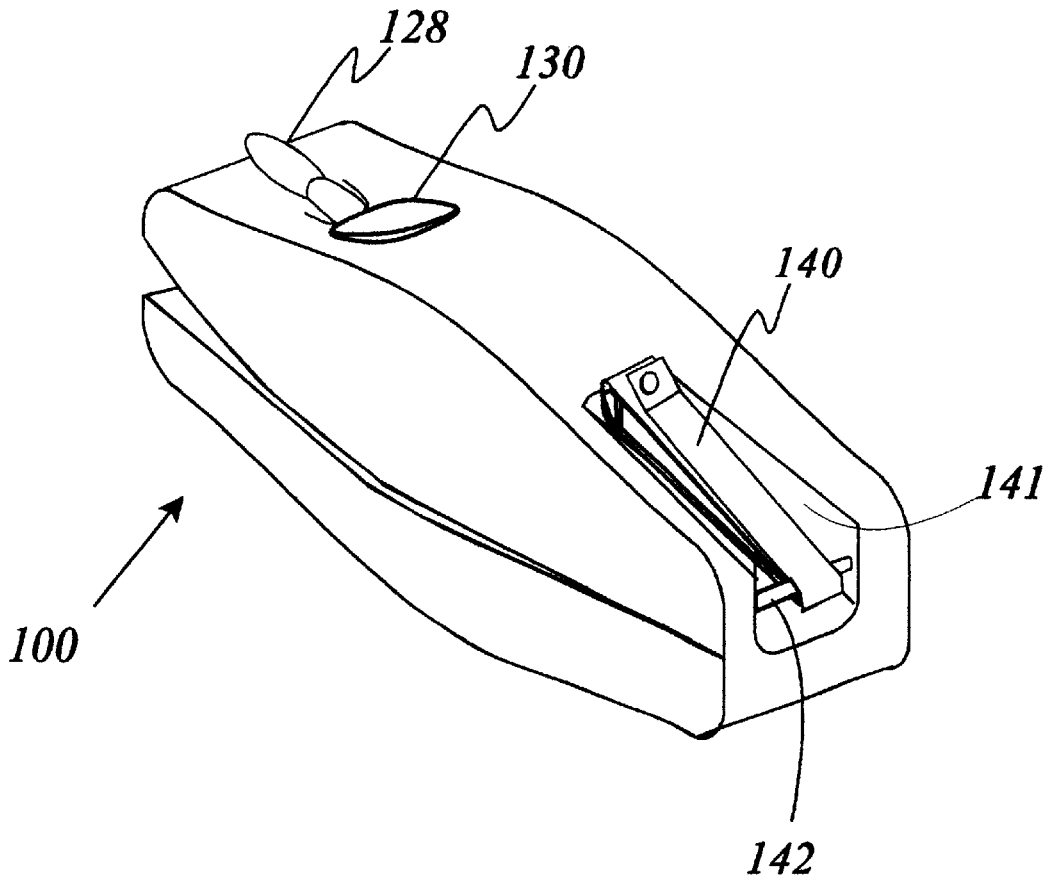
FIG. 9 is a perspective view of another alternative embodiment of the device according to the invention.
Figure 10:
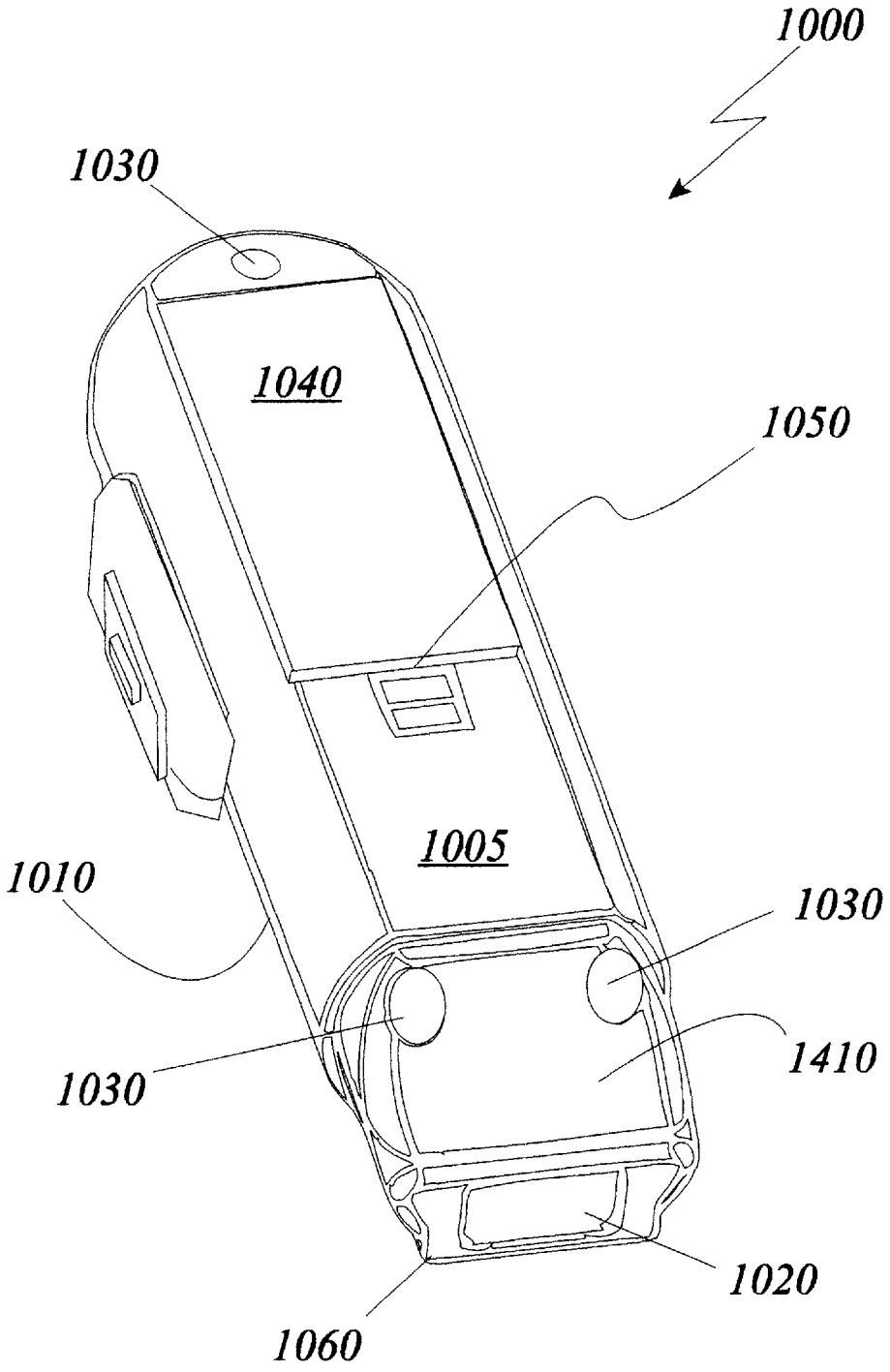
FIG. 10 is a perspective view of an alternate preferred embodiment of the device according to the invention.
Figure 11:
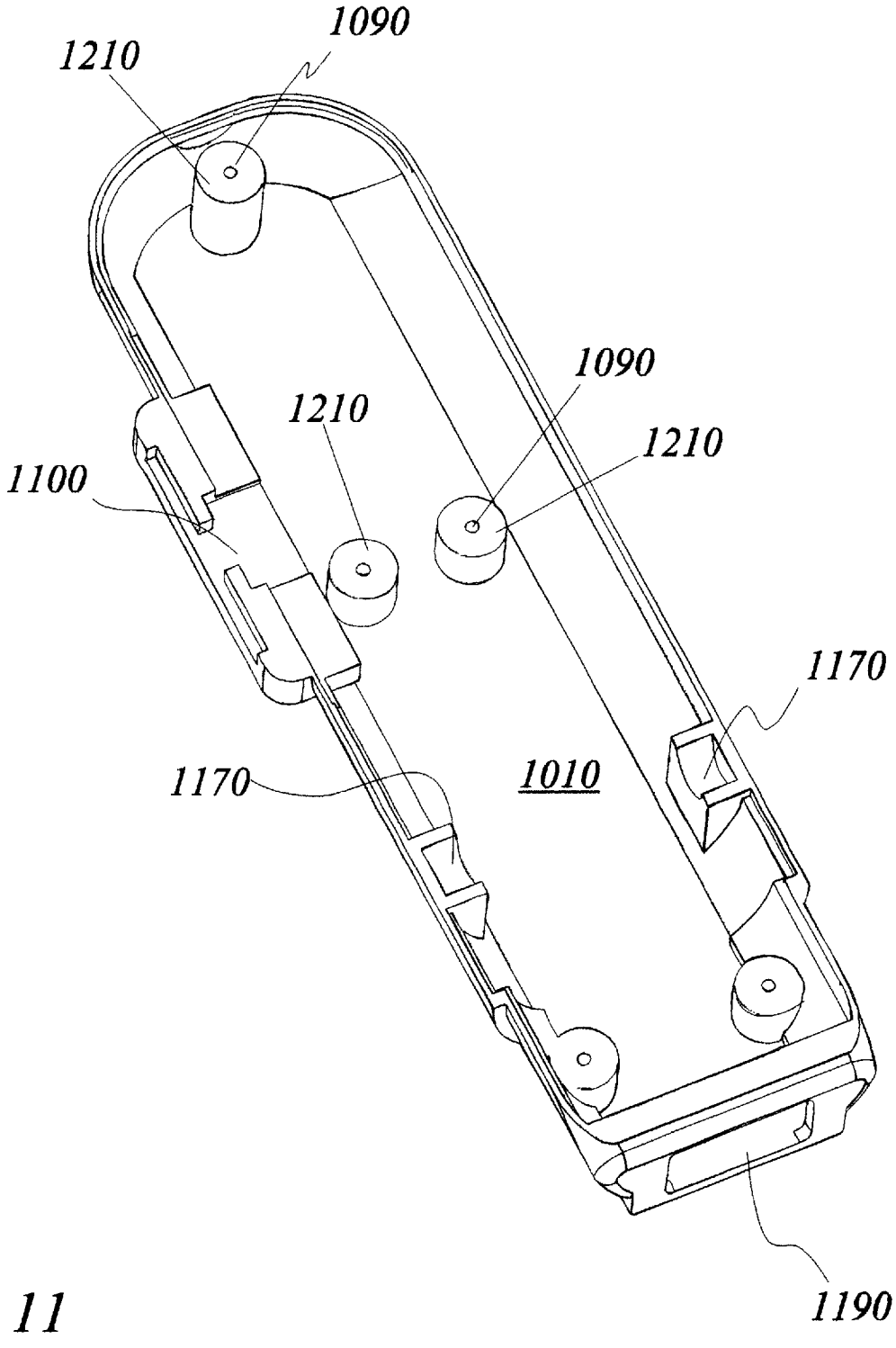
FIG. 11 is a perspective view of the bottom housing of the device shown in FIG. 10.
Figure 12:
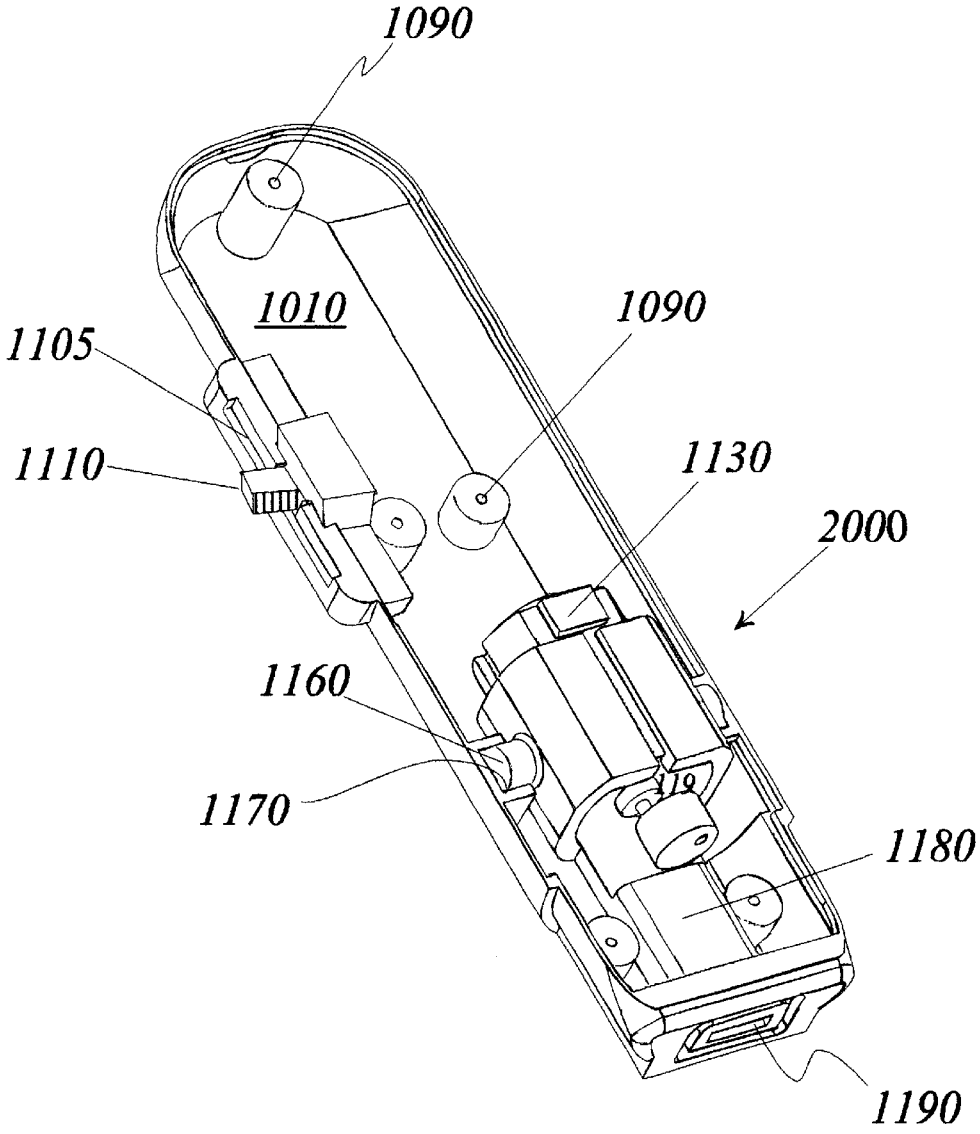
FIG. 12 is a perspective view of the bottom housing of the device shown in FIG. 10 with the motor.
Figure 13:
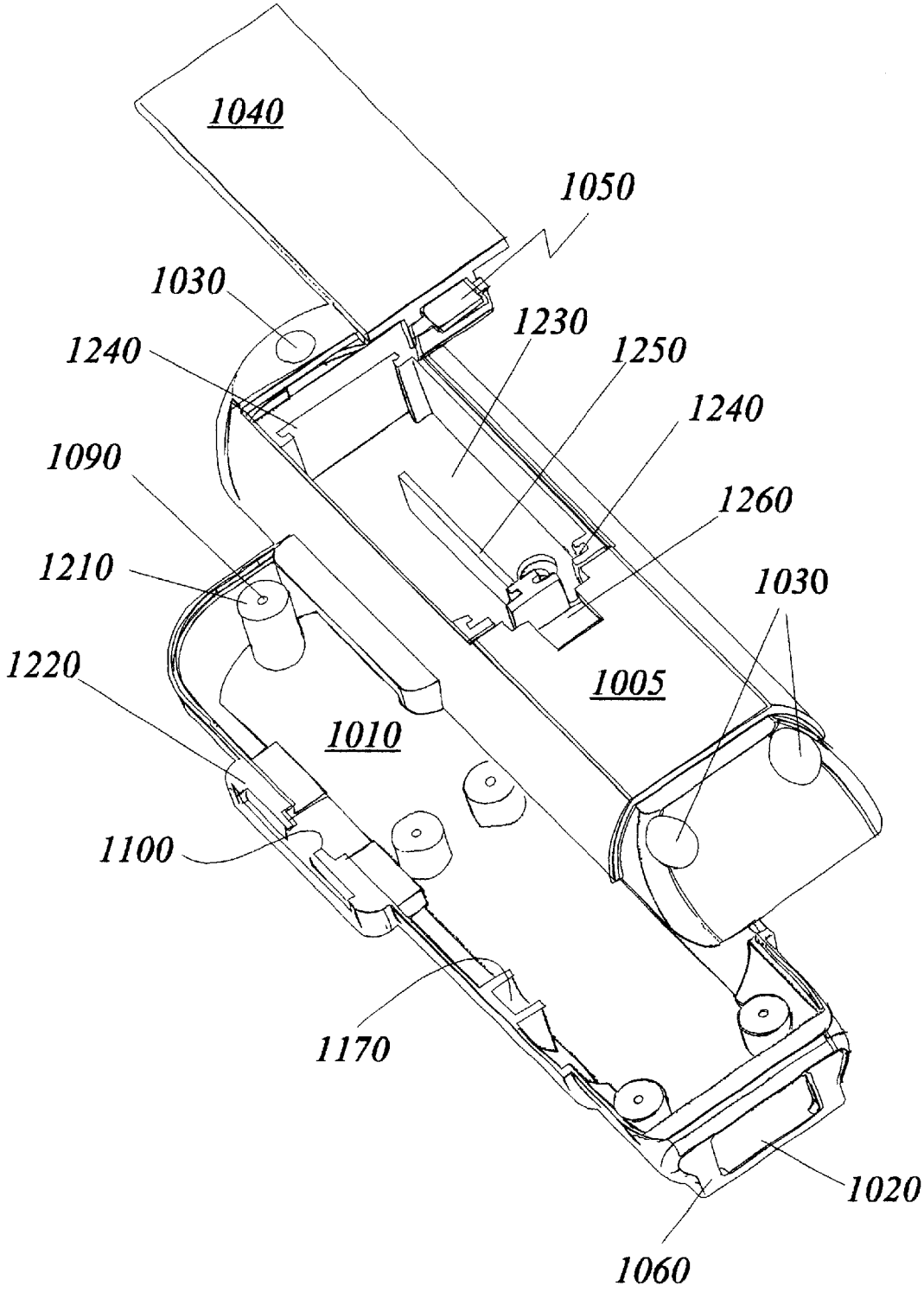
FIG. 13 is an exploded view of the device shown in FIG. 10.
Figure 14:
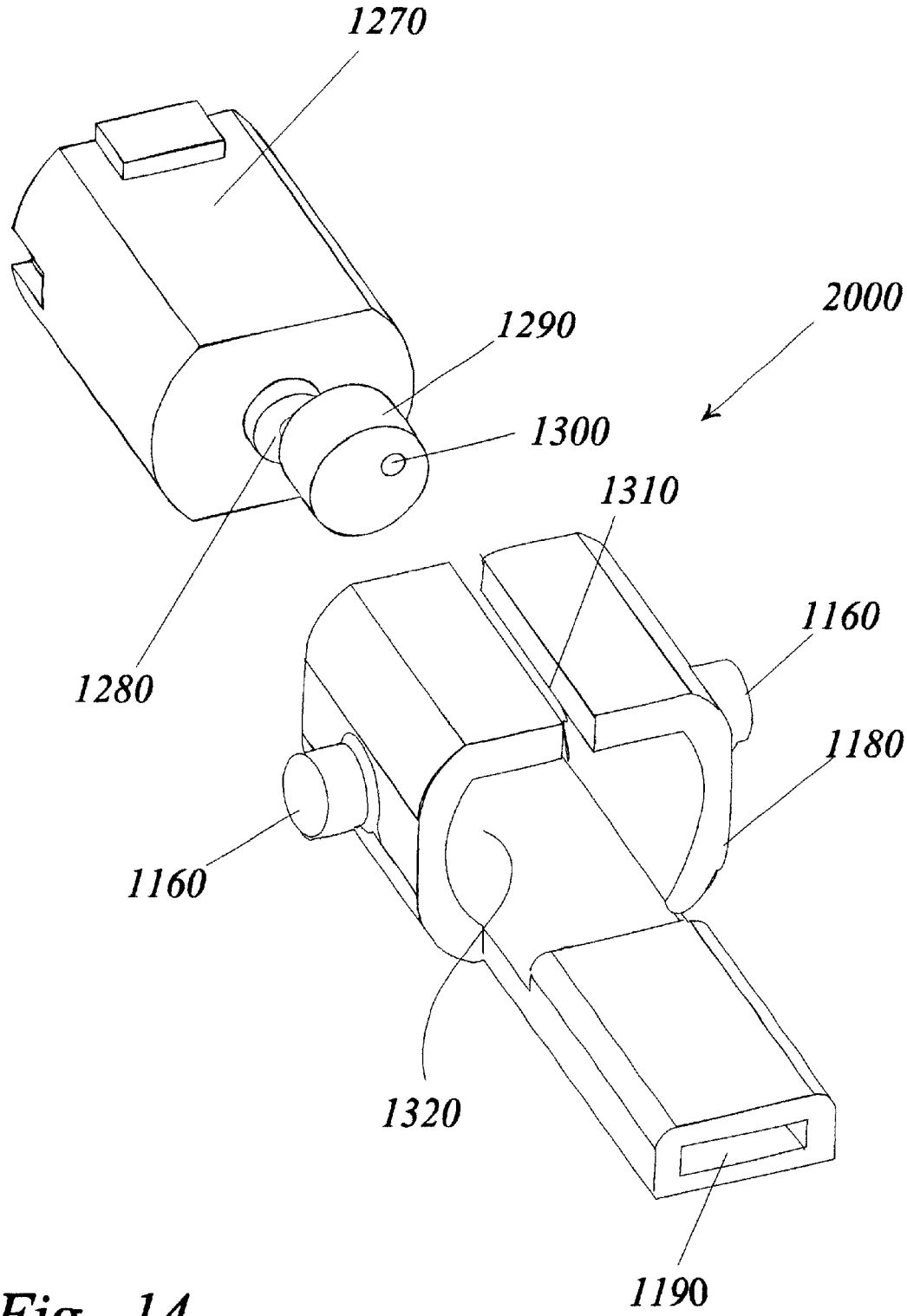
FIG. 14 is a perspective view of the bracket and motor of the device shown in FIG. 10.
Figure 15:
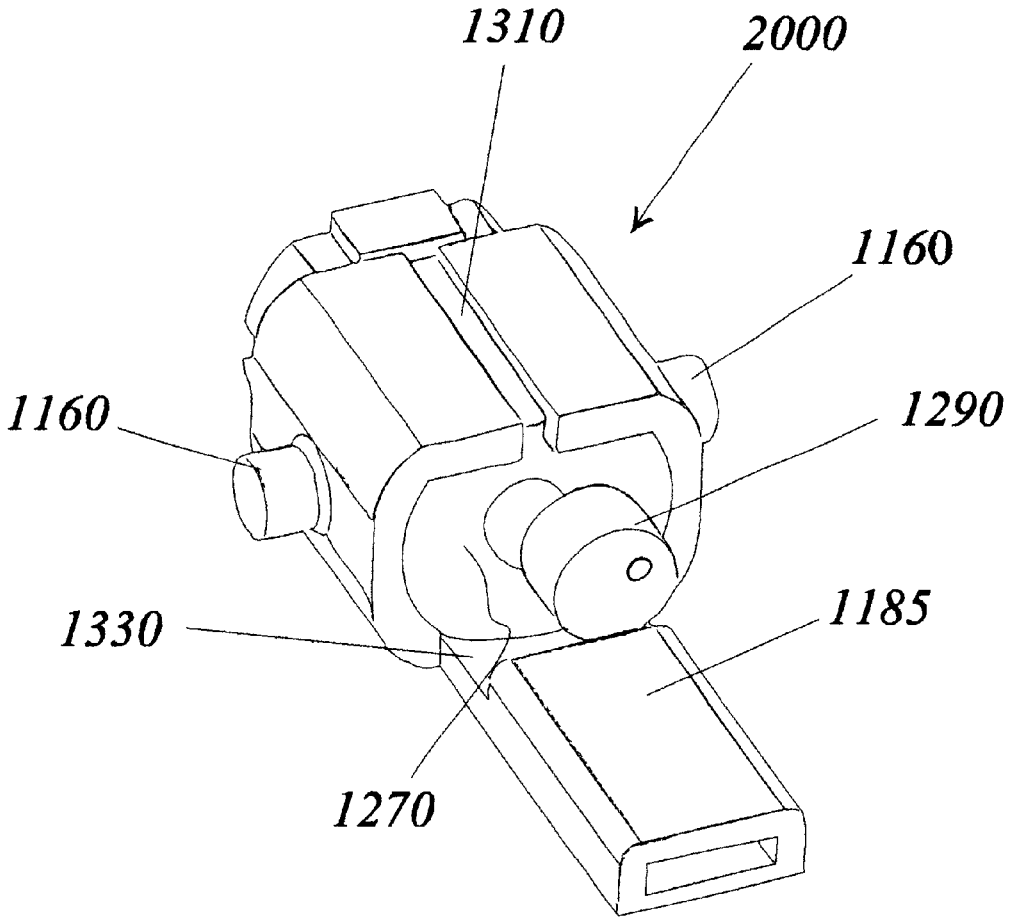
FIG. 15 is a perspective view of the motor in the bracket of the device shown in FIG. 10.

FIG. 9 shows another alternative embodiment of the invention, in which a nail clipper 140 is connected to device 100. Device 100 is equipped with a cavity 141 in which clipper 140 is situated. Clipper 140 is attached to device 100 by a bar 142 that extends across the hinged part of device 100. Other alternative ways of fastening clipper 100 could also be envisioned.

Referring now to FIGS. 10–16, an alternate preferred embodiment of the hand held massage device of the present invention is shown. The device comprises a main body 1000 having a top housing 1005 and a bottom housing 1010, a vibration source 2000 and a vibration surface 1350. The top housing 1005 is structured to be seated over the bottom housing 1010 in generally overlying relation thereto to form the main body 1000. The top 1005 and bottom 1010 housings are removably attached to one another via aligned mounting holes 1030, 1090 in the top housing 1005 and raised bosses 1210 in the bottom housing 1010, respectively. Screws or other attachment means known in the art may be utilized.

Top housing 1005 includes a recessed battery compartment 1230 having opposite sidewalls with recessed portions 1240 structured for insertion of circuit battery terminal connections. A centrally disposed partition 1250 is provided to maintain the batteries in position during assembly and use. Cover 1040 is structured to cover the battery compartment 1230 and retain the batteries therein. Snap coupling 1050 and cavity 1260 are provided to facilitate removal and replacement of the cover 1040. Other suitable attachment means known in the art may, alternatively, be used.

Bottom housing 1010 includes an outwardly extending flange 1220 with a recessed seating area 1100 and a longitudinally disposed channel 1105. The seating area 1100 and channel 1105 are structured to hold a graduated switch assembly 1110 therein. The switch 1110 is retained within the seating area 1100 when the top 1005 and bottom housings 1010 are secured to one another. The graduated switch 1110 enables the user to vary the vibration level of the device 1000. Any suitable switch known in the art may be utilized for this purpose.

The vibration source 2000 comprises a motor 1270 and motor 1270 is retained by bracket 1180. The bracket 1180 includes a pair of cylindrical-shaped studs 1160 extending out from opposite sides of the bracket 1180 and a channel 1320 extending longitudinally therethrough. The studs 1160 are structured to be seated within concave-shaped recesses 1170 in opposite sidewalls of the bottom housing 1010 so that the motor 1270 may freely rotate about the common longitudinal axis of the studs 1160, thereby allowing the motor 1270 to transmit only rotary energy to studs 1160 and restricting motion in any other direction. In this manner, most of the vibrational energy provided by the motor 1270 is directed towards the arm 1185 extending axially out from the channel 1320 and the vibration surfaces 1350 attached thereto, thereby minimizing the vibrations applied to the main housing and the user's hand. The channel 1320 is structured to retain the motor 1270 therein. A longitudinally disposed slot 1310 extending across the top surface of the bracket 1180 allows the bracket 1180 to be expanded for insertion and removal of the motor 1270.

The motor 1270 may be selected from those known in the art suitable for such hand held devices. A weight 1290 having a hole extending at least partially therethrough is attached to the motor shaft 1280 to provide the off balance force necessary to create the desired vibration level.

The vibration surface or vibration application tool 1350 includes a first end 1340 structured to be removably inserted in a coupling channel 1190 on arm 1185 and an opposite second end 1360 structured to receive at least one finger thereon and to transmit vibrations to such fingers. A gap is provided between the bracket 1180 and the coupling channel 1190 to enable the weight 1290 to freely rotate therein. An opening 1195 in the end of the bottom housing 1010 enables the first end 1340 of the vibration application tool 1350 to be inserted therethrough and into the coupling channel 1190.

Figure 16:
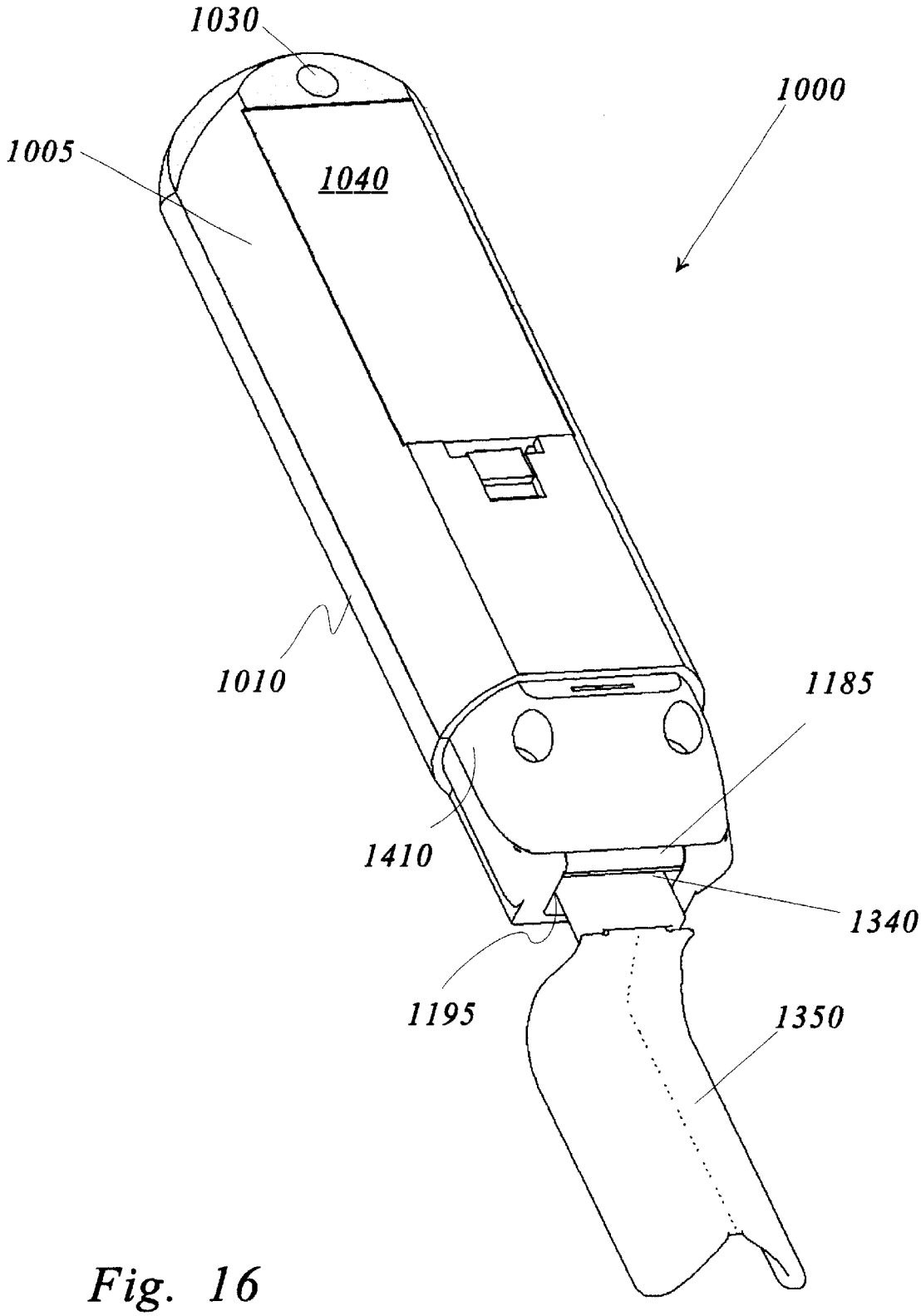
FIG. 16 is a perspective view of the device shown in FIG. 10 with the vibration surface attached to the main body.
Figure 17:
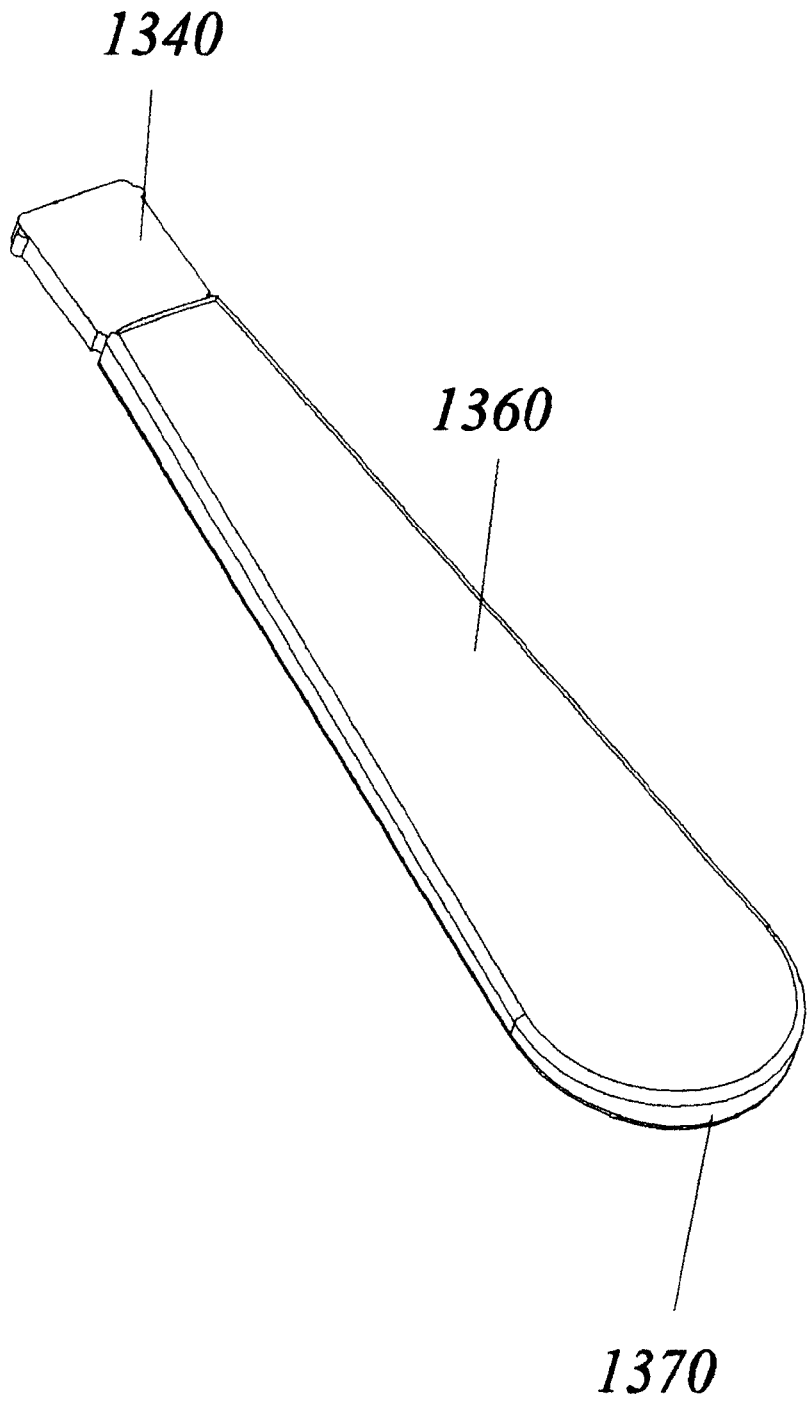
FIG. 17 is a perspective view of a vibration surface of the device shown in FIG. 10 with an elliptical-shaped cross section.
Figure 18:
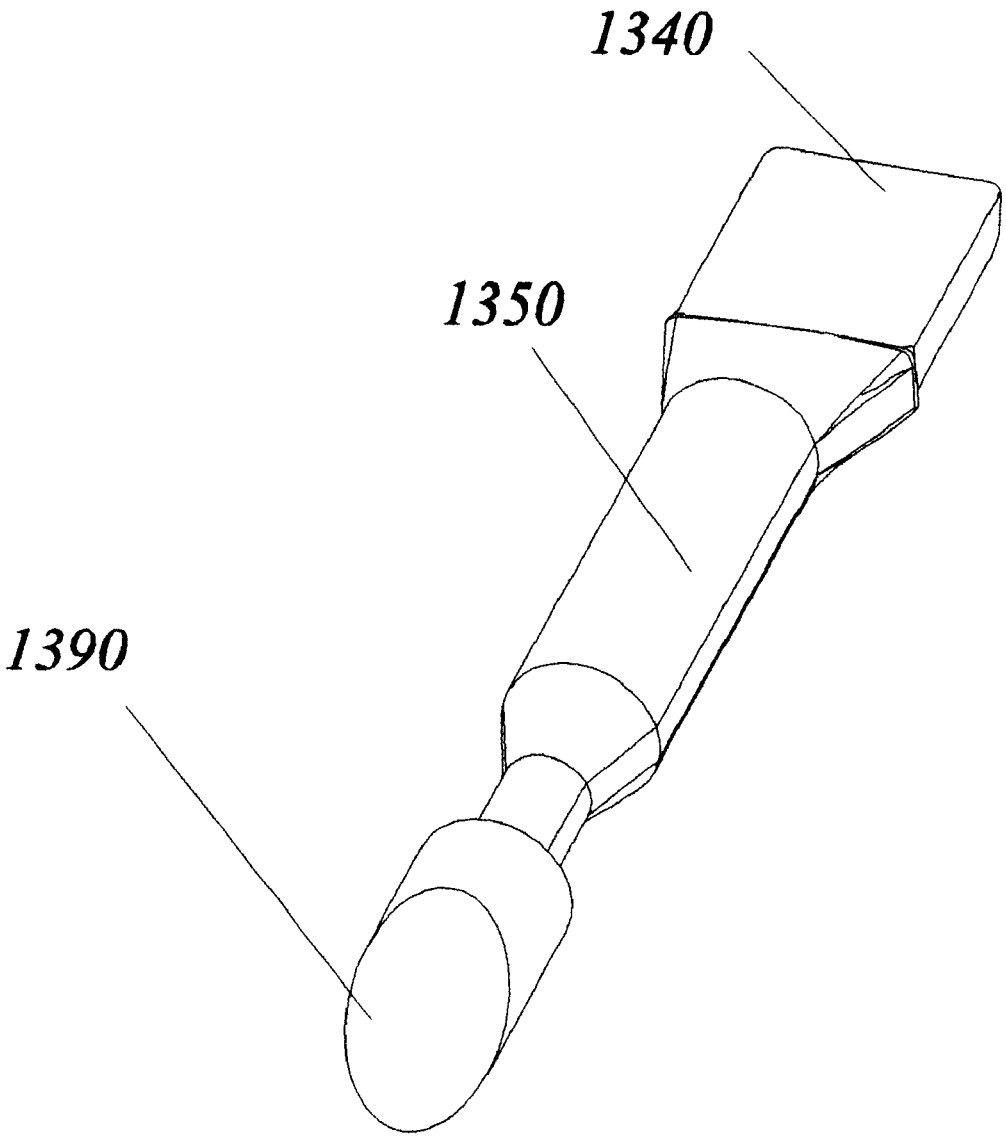
FIG. 18 is a perspective view of a vibration surface of the device shown in FIG. 10 with a flat, angled surface.

Referring now to FIGS. 16–18, the size and shape of the second end 1360 of the vibration application tool 1350 may be varied to achieve the desired vibration forces. For instance, a generally convex shape 1355 may be used to fit partially around a finger, a generally oval shape 1370 may be used to transmit varying vibration levels to the finger, or a flat, angled surface 1390 may be used as a type of buffing tool.

Figure 19:
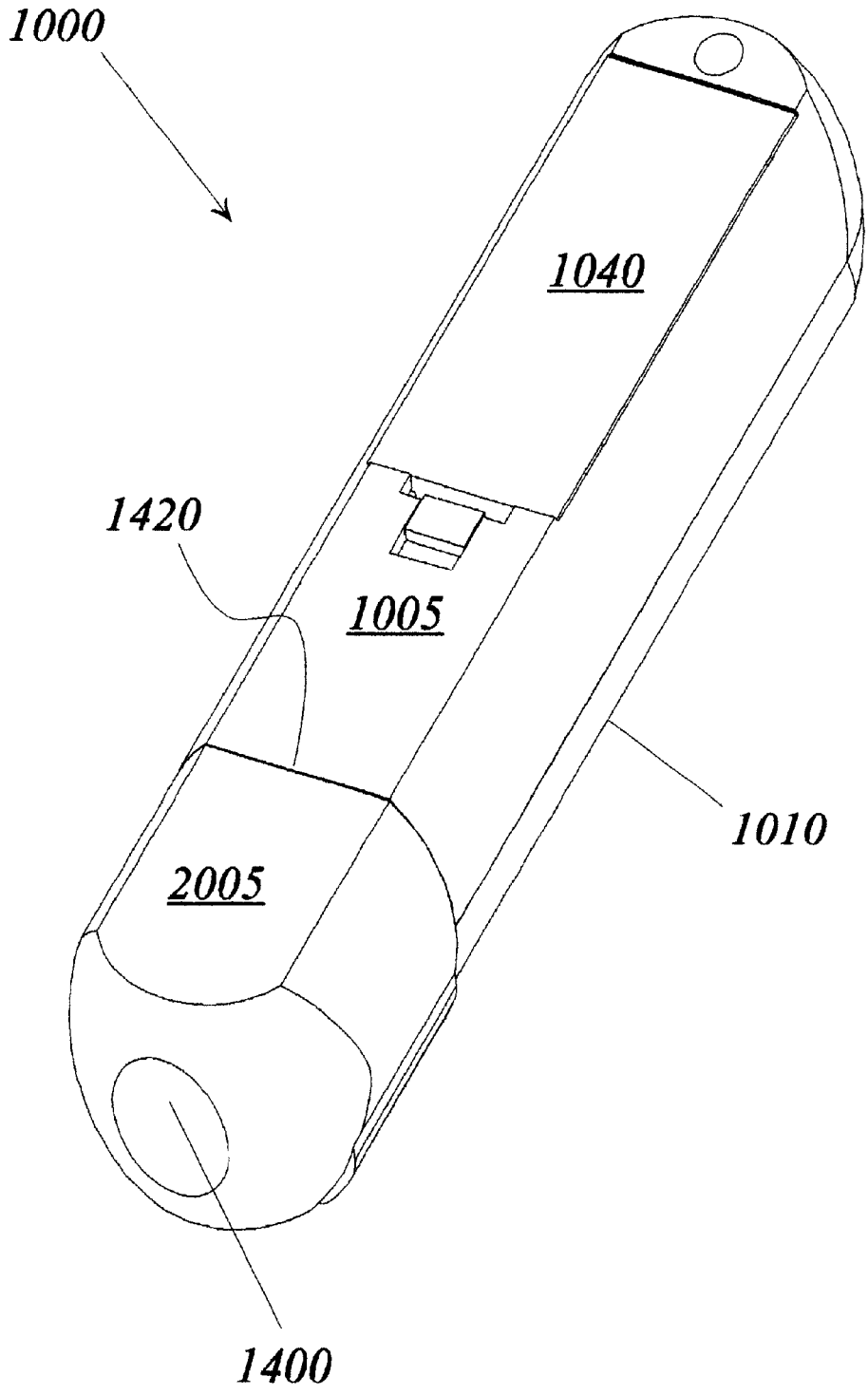
FIG. 19 is a perspective view of an alternate embodiment of the device according to the invention.

Referring now to FIG. 19, cover 2005 is structured to fit over angled surface 1410 of top housing 1005 to provide a more uniform overall appearance of the device 1000. Additionally, cover 2005 could be used to store the vibration application tools 1350 therein. The cover 2005 may also include a generally flat surface 1400 so that the device 1000 may be stood on its end.

Figure 20:
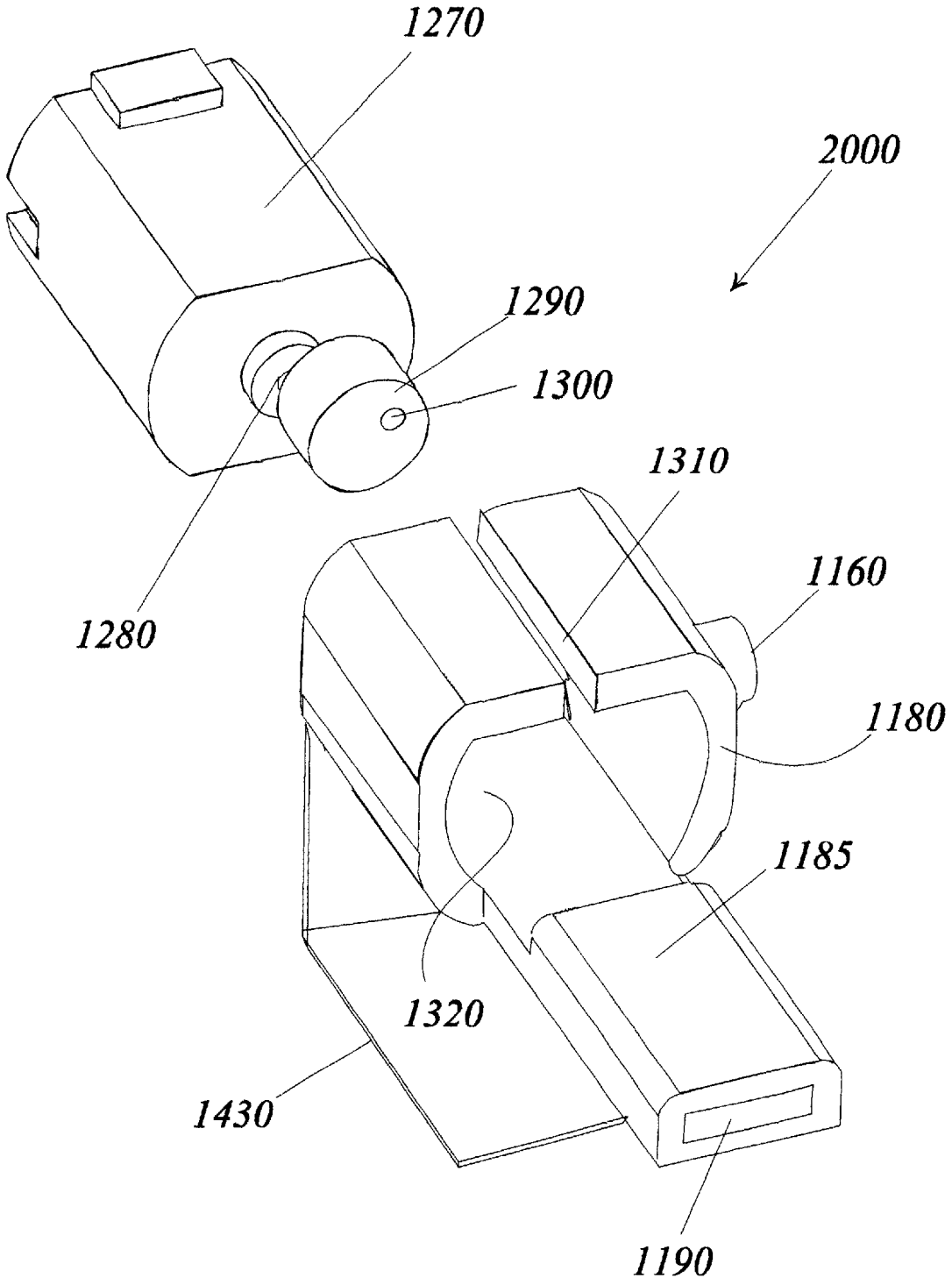
FIG. 20 is an isolated view of a motor and alternate bracket of the device according to the invention.

Referring now to FIG. 20, an alternate embodiment of the vibration source 2000 is shown. In this embodiment, the bracket 1180 and arm 1185 are suspended above a generally L-shaped base 1430. The base 1430 enables the motor 1270, bracket 1180 and arm 1185 to freely vibrate, thereby minimizing the vibrations transmitted to and dissipated within the top 1005 and bottom 1010 housings and, consequently, the user's hand.

Figure 21:
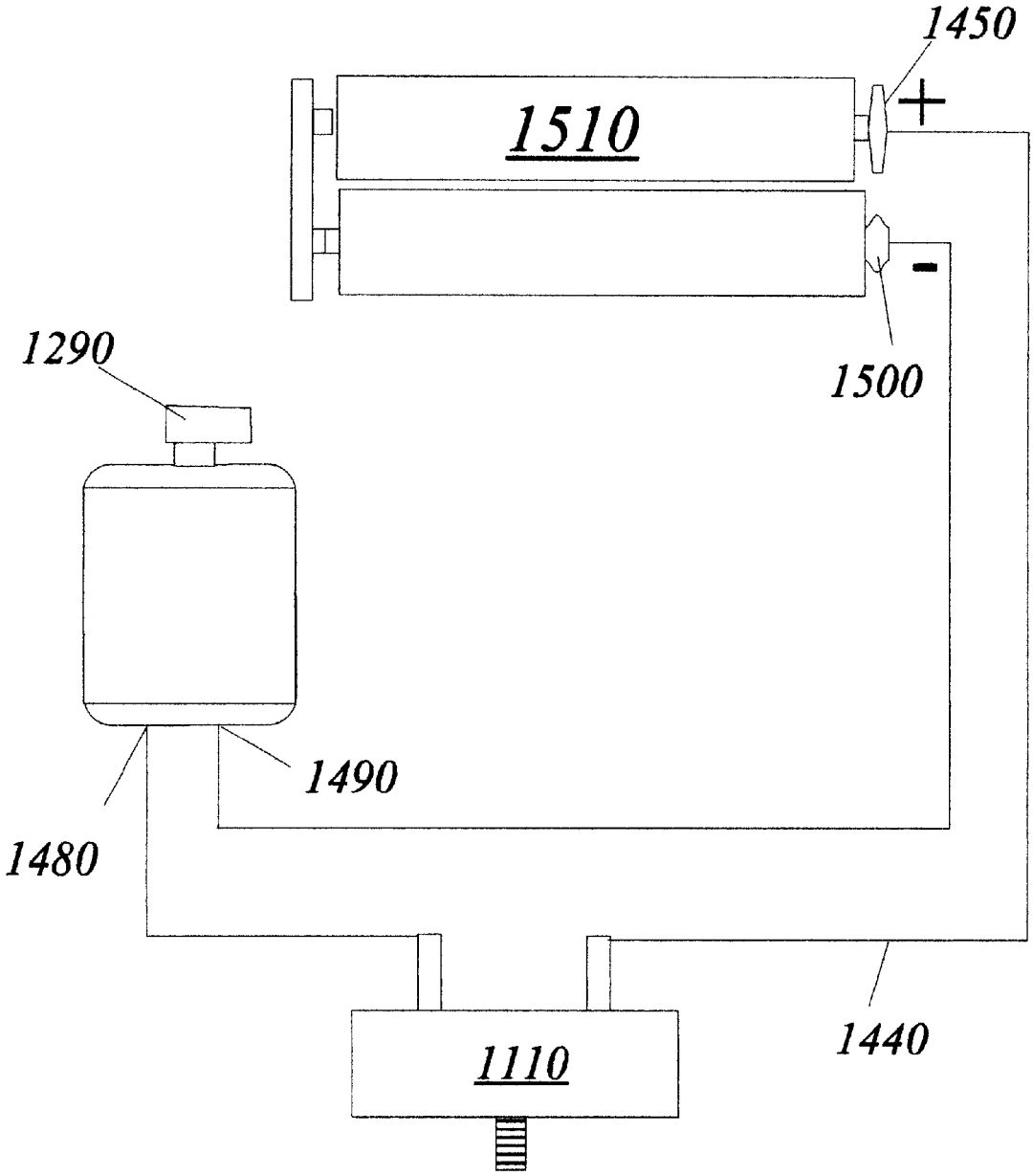
FIG. 21 is a schematic diagram of the battery, switch and motor circuitry of the device shown in FIG. 10.

Referring now to FIG. 21, a schematic diagram of the device shows the flow of current from batteries 1510 through wire 1440 from the positive voltage battery terminal 1450, through switch 1110, to the motor positive terminal 1480. The negative voltage battery terminal 1500 is electrically interconnected to the motor negative terminal 1490.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A hand held massage device comprising:

a main body sized in lateral circumference to be gripped and held in a single human hand and having:

a top housing having a top surface and surrounding sidewalls extending down from said top surface;

a bottom housing having a bottom surface and surrounding sidewalls extending up from said bottom surface;

a vibration source;

a power source operably connected to said vibration source; and means for activating said vibration source; and a vibration surface structured for receipt of at least one finger and to apply vibrations from said vibration source to said at least one finger; and an interior chamber defined by said top and bottom housings and a bracket mounted within said interior chamber, said bracket being structured to removably retain said vibration source therein, said bracket including a pair of studs extending out of opposite sides thereof, said studs being structured to be removably seated within slots in opposing longitudinal sidewalls of said bottom housing, thereby allowing said vibration source to freely rotate about a common longitudinal axis of said studs so that vibrations are predominately directed towards said vibration surface.

2. A hand held massage device as recited in claim 1 wherein said vibration surface includes a first end zone structured for removable attachment to said bracket through a slot in one of said sidewalls and an opposite second end zone structured for contact with at least one finger.

3. A hand held massage device as recited in claim 2 wherein said bracket includes a longitudinally extending portion having an open-ended retaining channel thereon, said retaining channel being structured and disposed to receive said first end zone of said vibration surface therein.

4. A hand held massage device as recited in claim 2 wherein said second end of said vibration surface includes a generally concave-shaped cross-section.

5. A hand held massage device as recited in claim 2 wherein said second end of said vibration surface includes a generally elliptical-shaped cross-section.

6. A hand held massage device as recited in claim 2 wherein said second end of said vibration surface includes a generally flat, angled surface.

7. A hand held massage device comprising:

a main body sized in lateral circumference to be gripped and held in a single human hand and having:

a top housing having a top surface and surrounding sidewalls extending down from said top surface;

a bottom housing having a bottom surface and surrounding sidewalls extending up from said bottom surface;

a vibration source operative to produce vibrations in a predetermined direction;

a power source operably connected to said vibration source; and means for activating said vibration source; and a vibration surface structured for receipt of at least one finger and to apply vibrations from said vibration source to said at least one finger; and an interior chamber defined by said top and bottom housings and a bracket mounted within said interior chamber, said bracket being structured to removably retain said vibration source therein, said bracket being pivotally mounted in said interior chamber on an axis transverse to said direction of vibrations, so that vibrations are predominately directed towards said vibration surface.

* * * * *